United States Patent [19]

McLean

[11] 4,221,616

[45] Sep. 9, 1980

[54] HYDROPHOBIC EXPLOSIVE COMPOSITION AND METHOD OF MAKING

[75] Inventor: Colin D. McLean, Mulgrave, Australia

[73] Assignee: ICI Australia Limited, Melbourne, Australia

[21] Appl. No.: 3,516

[22] Filed: Jan. 15, 1979

[30] Foreign Application Priority Data

Jan. 26, 1978 [AU] Australia ..... PD3159

[51] Int. Cl.[2] ..... C06B 45/00

[52] U.S. Cl. ..... 149/2; 149/21; 149/92; 149/93; 149/105; 149/111; 149/41; 149/47; 149/55; 149/62; 149/69

[58] Field of Search ..... 149/2, 93, 92, 105, 149/111, 21, 47, 55, 41, 62, 69

[56] References Cited

U.S. PATENT DOCUMENTS 3,676,234 7/1972 Schwoyer ..... 149/111 X

*Primary Examiner*—Stephen J. Lechert, Jr.

*Attorney, Agent, or Firm*—Cushman, Darby & Cushman

[57] ABSTRACT

A slurry explosive composition comprising at least one inorganic oxidizing salt, an aqueous liquid phase, fuel material and a sensitizing agent which agent comprises a combination of hydrophobic particles of high explosive material and gas bubbles.

14 Claims, No Drawings

HYDROPHOBIC EXPLOSIVE COMPOSITION AND METHOD OF MAKING

This invention relates to explosive compositions of matter and more particularly it relates to slurry explosive compositions of matter.

Slurry explosives comprise inorganic oxidizing salt, fuel, a liquid solvent, disperser or carrier for said salt and, optionally, at least one thickening agent. Although the term "slurry" is applied to such compositions the degree of consistency may range from pourable or pumpable fluids of varying viscosity, through viscous extrudable gels up to friable materials such as are described in Australian Pat. No. 483,568 and which may be packaged in the form of cartridges. The oxidizing salt component usually comprises nitrate, chlorate or perchlorate of ammonia, sodium, potassium, calcium or barium, the most extensively used salt being ammonium nitrate. The liquid phase may vary widely in its chemical constitution, consistency, and explosive sensitivity but commonly slurry explosives are aqueous. Thus, the liquid phase may consist mainly of an aqueous solution of inorganic oxidizing salt. So as to increase the viscosity of slurry explosives of the kind described thickening agents for example gums such as guar gum or xanthan gums, or synthetic polymers such as polyacrylamide or copolymers thereof have been used in an attempt to prevent segregation of the ingredients or to prevent deterioration in wet conditions. It has also been proposed that improved homogeneity and storage properties could be obtained by crosslinking the thickening agents with crosslinking agents, for example potassium pyroantimonate, sodium dichromate, potassium dichromate or rare earth salts, or a redox system for example a mixture of an aersenious compound and sodium dichromate. It has also been proposed to use agents which are capable of sensitizing the explosive compositions to the action of detonating materials, and typically such sensitizing agents have included metallic materials such as finely divided aluminium often referred to as "paint-fine" aluminium optionally in the presence of a gas located within the composition. It has also been proposed to use high explosive materials, such as trinitrotoluene (TNT), in the form of large flakes or pellets as sensitizing agents for slurry explosive compositions. It has also been proposed in the specification of U.S. Pat. No. 3,216,872 to use in an aqueous slurry explosive containing as an essential oxygen-releasing salt component a mixture of inorganic nitrates, from about 10 to 30% w/w of a high explosive material as a sensitizing agent, the agent having a sufficiently small particle size that is passes through a standard 30 mesh sieve, and typical examples of such an agent are exemplified as being trinitrotoluene of which only about 0.25% w/w passes a 120 mesh sieve, or pentaerythritol tetranitrate (PETN) (50 mesh), or cyclonite (30 or 40 mesh).

Surprisingly, and in contradistinction to the teachings of the prior art that finely divided high explosive sensitizing agents having a particle size finer than would be retained on a 30 mesh sieve are prone to desensitization by water unless they are used in the presence of at least two inorganic nitrates, it has now been found that slurry explosive compositions containing one or more oxygen-releasing salts may be rendered very sensitive to detonation if there is present in the composition a sensitizing agent comprising finely divided hydrophobic high explosive material in combination with gaseous material.

Accordingly the present invention provides a slurry explosive composition which comprises at least one inorganic oxidizing salt, a liquid phase, fuel material, and optionally at least one thickening agent which optionally may be crosslinked, characterised in that said slurry explosive comprises, as a sensitizing agent, first, hydrophobic, as hereinafter defined, particles of a high explosive material which are capable of passing through a screen of 120 BS mesh, and secondly, bubbles of gaseous material.

By sensitizing agent we mean a material which when added to an explosive composition of fixed dimensions reduces the minimum primer necessary to initiate that explosive composition.

Although we wish in no way to be bound by this theory, we believe that the mode of action of the sensitisers of this invention is to surround the gas bubbles and consequently to decompose rapidly at the temperature of the hot spot formed when the shock wave interacts with a gas bubble, thereby increasing the temperature of the hotspot to a value where the bulk of the explosive will decompose explosively.

We base this theory on the observations that the particles of the high explosive must be hydrophobic, hence they will tend to collect at the interface of the gaseous bubbles and the slurry composition, and that they must be smaller than those retained on a 120 BS mesh screen implying that this small size is necessary to allow them to collect at the interface.

By hydrophobic we mean that the particles of the high explosive component are not wetted by the liquid which provides the liquid phase in the slurry explosive composition. The particles are deemed to be not wetted by a liquid when, if they are scattered on the surface of the said liquid as it is agitated, they float and remain in that state for at least one hour in the absence of any further agitation of the said liquid.

A high explosive is an explosive composition characterized by very high rates of reaction (1.6 to 10 kilometers/sec.) and high pressures (3 to 300 kbars) during detonation—(Engineering and Mining Journal October 1976, p 81).

Trinitrotoluene is a very convenient high explosive material for use in the invention. Other explosive materials which give good results include dinitrotoluene, pentaerythritol tetranitrate, pentolite which is a mixture of equal weights of pentaerythritol tetranitrate and TNT, tetryl, cyclonite and various mixtures of TNT and cyclonite such as composition B and cyclotol.

Conveniently the high explosive component constitutes up to 10% w/w of the composition and for many compositions adequate sensitivity to detonation is acquired when the high explosive component constitutes from 1 to 5% w/w of the composition.

In some cases the particles of the high explosive material are hydrophobic with respect to the liquid phase in their own right but in others they have to be treated to render them hydrophobic. For example, if the high explosive material used is pentaerythritol tetranitrate and the liquid phase is aqueous, then the pentaerythritol tetranitrate particles require to be treated with an agent, such as di-iso-octylphthalate and other water resisting agents as listed in copending Australian Pat. No. 35094/78, to prevent them being wetted by the aqueous phase.

The gaseous component of the bubbles of the sensitizing agent may be for example air, oxygen, nitrogen or an oxide of nitrogen. The gaseous component such as air may be entrained into the composition by agitation of the composition for example by stirring, or alternatively it may be fed into the composition in the form of a compressed gas, or yet again it may be formed in situ in the composition by the decomposition of a gas-forming material present in the composition. Thus for example small amounts of sodium nitrite may be used as a decomposable component of the composition.

In general, except for the sensitizing agent, the compositions of our invention are of conventional types. Thus the oxygen releasing salts used as ingredients in our compositions may be, for example, inorganic nitrates, chlorates and perchlorates and mixtures thereof. We prefer that the oxygen releasing salt material be chosen from the perchlorates or nitrates of the alkali and alkaline earth metals or ammonium and of these we prefer sodium nitrate, calcium nitrate, ammonium perchlorate and particularly ammonium nitrate. The amount of oxygen releasing salt in such compositions is not narrowly critical; we have found that compositions containing amounts of oxygen releasing salts from 50% w/w to 90% w/w of the total composition are satisfactory and amounts from 60% w/w to 85% w/w are preferred. The particle size and shape of the oxygen releasing salt is not critical and is well known from the art of ammonium nitrate manufacture; powders and prilled particles are satisfactory.

The liquid phase comprises an aqueous solution. The amount of water in this aqueous liquid phase should be sufficient to dissolve at least part of the oxygen releasing inorganic salt and at least part of any water soluble fuel which may be present, and also be sufficient to hydrate at least part, preferably all, of any gummy gelling agent present. Suitably the amount of water when present may constitute from 3% w/w to 35% w/w of the total composition, but the amount present should not be in excess of the explosive limit of the composition. We prefer that the water be in the range from 3% w/w to 25% w/w of the total composition. In the instance where the explosive composition is of the pourable or pumpable type it is more preferred that water constitutes from 12% w/w to 17% w/w of the composition; where the composition is of a friable type a very suitable range for the water content is from 3% w/w to 14% w/w and a range from 4% w/w to 10% w/w is especially preferred.

When referring to fuels or fuel materials in this specification we mean substances which are stable in such explosive compositions, that is prior to detonation, and during preparation and storage the substance is chemically inert to the system. The said substances must be combustible and their physical nature should be such that they may be incorporated in our compositions in a manner so as to be uniformly distributed throughout the compositions. Such fuels are well known in the art and they may be organic or inorganic and may also be derived from animals and plants.

The fuels when employed in the compositions of this invention can be, for example, non-explosive carbonaceous, non-metallic and metallic fuels or mixtures of the aforementioned types of fuels. They can be varied widely.

Suitable fuels include organic water soluble substances for example urea, carbohydrates such as sugars or molasses, water soluble alcohols or glycols, glues or mixtures of these. Suitably the proportion of water soluble fuel in our compositions is in the range from 0.5% w/w to 10% w/w, preferably from 4 to 7% w/w, of the total composition.

Other suitable fuels include water insoluble or sparingly water soluble materials which may be chosen from inorganic materials for example sulphur, aluminium, silicon, ferrosilicon, ferrophosphorus, magnesium, titanium, boron, mixtures thereof for example mixtures of aluminium with ferrosilicon, or organic materials for example finely divided charcoal, anthracite, gilsonite, asphalt, cellulosic materials such as sawdust, or cereal products for example flours, dextrins or starches. When the inorganic fuel is a metal it is preferably in granulated or powdered form. Such granulated or powdered metal may be in the form of discrete particles, but metal powders wherein the metal is in the form of flakes or in the form of aggregates of particles or flakes are also satisfactory. Preferred fuels are the metallic powders. The most preferred metallic fuel is aluminium. The proportion of water insoluble or sparingly water soluble nonmetallic fuels in such compositions may suitably be in the range from 1% w/w to 10% w/w of the total composition and amounts from 4% w/w to 7% w/w of the total composition are preferred. The proportion of metallic water insoluble fuels when present in such compositions may be as high as 25% w/w and amounts in the range from 0.5% w/w to 20% w/w of the total compositions are preferred.

Where desirable there may be included as a component of our compositions one or more conventional thickening agents, for example gums such as the galactomannan or xanthan gums. Typical examples of galactomannan gums are guar gum or derivatives thereof and locust bean gum whilst the xanthan gums may be typified by reference to biopolymeric materials which are produced by processes comprising the transformation of carbohydrate material by means of micro-organisms such as those of the species of *Xanthomonas*. A very useful biopolymeric material is that available under the trade name of "Biopolymer" XB23 which is derived from a polymer which has been reacted with *Xanthomonas campestris*. Preferably such gums, when used in our compositions are in a crosslinked form. When such gums are used in our compositions it is convenient to use amounts such that the gum component comprises from 0.1 to 5% w/w, more usually from 0.3 to 3% w/w, of the composition.

In general the explosive compositions of our invention may be prepared by the conventional formulating techniques used for preparing slurry explosives. Thus for example a part or all of the oxygen releasing salt may be in the form of a solution of the salt or part may be incorporated in powdered or prilled form. Fuel materials when used may also be incorporated in a dry form or alternatively in the form of a dispersion or solution in part of the liquid component. It has been found convenient to incorporate the high explosive component of the sensitizing agent to the composition by adding it to a composition which comprises the gaseous component of the sensitizing agent. Suitably such incorporation may be effected by adding the high explosive component by itself or as a dispersion in a part of the liquid component of the composition.

When guar gum is used as a component of the compositions of the invention it is preferred that there is present in the composition a sufficiency of liquid to ensure that the gum component is at least partially solvated. When agents are used to crosslink such gum it is preferred that such an agent be added as one of the final ingredients. In instances where such a crosslinking agent is a system comprising two or more components it is desirable that whilst some of the components may be incorporated at any stage of the preparation of the mixture, the last ingredient added is a component of the crosslinking system. Thus for example when such a crosslinking system is a redox system it is desirable that the oxidizer component of that system be added to the composition as the final ingredient. Other thickening agents such as synthetic polymers and copolymers may also be used; for example polymers derived from acrylamide, and especially copolymers derived from acrylamide and containing mer units which bear bidentate groups are satisfactory. Typical examples of such copolymers are those derived from a major proportion of acrylamide and a minor proportion of 2-acetoxyethyl methacrylate or methacryloylacetone optionally with mer units derived from acrylonitrile.

The invention also includes a method of preparing a slurry explosive composition, which method comprises mixing inorganic oxidizing salt and fuel material with a liquid solvent disperser or carrier for said salt, optionally mixing therewith at least one thickening agent which optionally may be crosslinked, to form a mixture and modifying the sensitivity characteristics of said mixture by incorporating therein an amount of sensitizing agent as hereinbefore described.

The compositions of the invention are advantageous over similar compositions of the prior art in that their enhanced sensitivity characteristics may be achieved by the use of a relatively small amount of the high explosive component of the sensitizing agent. Thus their cost is reduced and furthermore the use of the smaller amounts of high explosive has the attendant advantage of reducing hazards of manufacture.

The invention is now illustrated by, but is not limited to, the following examples wherein all parts and percentages are expressed on a weight basis unless otherwise specified. Examples 7 to 11 inclusive and 14 do not lie within the invention and are included for the purposes of comparison.

EXAMPLE 1

An explosive composition containing 3% TNT as a high explosive component of a sensitizing agent was made by preparing a first composition by mixing 4450 parts of ammonium nitrate powder, 1300 parts of sodium nitrate powder and 1000 parts of water. A second composition was prepared by mixing 30 parts of thiourea, 15 parts of guar gum, 34 parts of ethylene glycol, 1350 parts of crushed ammonium nitrate, 250 parts of pregelled starch, 50 parts of sodium carboxymethylcellulose, 580 parts of urea and 700 parts of a coarse atomized aluminium powder. This second composition was added to and mixed with the first composition referred to above to form a homogeneous mixture which was slightly acidic. This homogeneous mixture was stirred still further whilst there was added thereto 40 parts of sodium nitrite, 300 parts of finely divided trinitrotoluene and 1 part of zinc chromate. (The trinitrotoluene referred to above was prepared by dissolving trinitrotoluene in hot methanol to form a solution, pouring this solution into water to effect a rapid precipitation of trinitrotoluene, classifying the precipitate so formed and recovering for use in the composition of the invention that portion of the particulate trinitrotoluene which passed through a 120 mesh sieve). The composition so obtained which had a density of 1.04 grams/cubic centimeters was packed into cylindrical cardboard tubes which were 35 centimeters along and had a diameter of 2.5 centimeters. The composition was detonated in this unconfined state at a temperature of 22° C. by means of two No. 8 detonators each of which contained approximately 0.45 gram of PETN.

EXAMPLES 2 TO 6 INCLUSIVE

The general procedure of Example 1 was repeated except that each of the amounts of TNT, the diameter of the cardboard tube, and the temperature of detonation was varied as shown in Table 1. The amount of gaseous component in the composition was charged in Examples 3 to 6 inclusive and these changes are illustrated by the values of the density shown in Table 1. The greater the density value, the less was the amount of gaseous component in the composition.

TABLE 1

| Example No | TNT (parts) | Diameter of tube (cm) | Temperature of detonation (°C.) | Density (gm/cc) | Minimum Primer for detonation |
|---|---|---|---|---|---|
| 2 | 1000 | 2.5 | 26 | 1.04 | 1 × No6 (0.22 gm PETN) |
| 3 | 1000 | 2.5 | 22 | 1.23 | 2 × No8 |
| 4 | 300 | 5.0 | 22 | 1.20 | 3 × No8 |
| 5 | 300 | 5.0 | 27 | 1.10 | 1 × No8 |
| 6 | 300 | 5.0 | 27 | 1.40 | 5 gm Pentolite |

EXAMPLE 7

In this comparative Example the general procedure of Example 3 was repeated except that the finely divided trinitrotoluene of that Example was replaced by 1000 parts of granular trinitrotoluene which was retained on a 60 mesh sieve. The minimum primer for detonation of this composition was 10 grams of pentolite.

EXAMPLES 8 TO 10 INCLUSIVE

For the purposes of comparison these examples record the sensitivity of prior art compositions set out in Examples 1 to 4 inclusive of the specification of U.S. Pat. No. 3,216,872 and reproduced in Table 2. Table 2 also shows the density of the composition and the amount of pentolite required to detonate the composition under confined conditions in a steel pipe having a diameter of 1.25 inches (3.2 centimeters). The TNT used as the sensitizing agent in these examples had the following screen analysis.

| US Standard Screen Mesh size | Screen Analysis of TNT % by Weight |
|---|---|
| −30 + 40 mesh | 0.25 |
| −40 + 50 mesh | 26.25 |
| −50 + 70 mesh | 59.00 |
| −70 + 100 mesh | 12.25 |
| −100 + 120 mesh | 2.00 |
| −120 + 200 mesh | 0.25 |
| −200 + 230 mesh | Trace |
| −230 | Trace |
| | 100.00 |

TABLE 2

| Example No | 8 | 9 | 10 | 11 |
|---|---|---|---|---|
| USA Patent Example No | 1 | 2 | 3 | 4 |
| Component | Parts by weight | | | |
| Fine TNT | 20.0 | 20.0 | 20.0 | 20.0 |
| Mill ammonium nitrate | 56.5 | 47.2 | 39.5 | 20.7 |
| Mill sodium nitrate | 5.0 | 15.0 | 24.2 | 40.0 |
| Zinc oxide | 0.3 | 0.3 | 0.3 | 0.3 |
| Bagasse | 1.0 | 1.0 | 1.0 | 1.0 |
| Cornstarch | 3.2 | 2.5 | 0.0 | 0.0 |
| Hydroseal 3B | 2.0 | 2.0 | 3.0 | 3.0 |
| Water | 16.0 | 16.0 | 16.0 | 18.0 |
| Oil No 5 | 0.0 | 0.0 | 0.0 | 1.0 |
| Sea coal | 0.0 | 0.0 | 0.0 | 1.0 |
| Total | 104 | 104 | 104 | 105 |
| % TNT | 19.2 | 19.2 | 19.2 | 19.2 |
| Pentolite used (grams) | 10 | 10 | 3 | 30 |
| Density (gm/cc) | 1.36 | 1.44 | 1.47 | 1.48 |

EXAMPLE 12

5240 Parts of powdered ammonium nitrate were added to and mixed with 100 parts of water to form a first composition. A second composition was prepared by mixing together 30 parts of thiourea, 15 parts of guar gum, 34 parts of ethylene glycol, 2000 parts of crushed ammonium nitrate prills, 250 parts of pregelled starch, 50 parts of sodium carboxymethylcellulose and 340 parts of urea. The first composition and the second composition were mixed with stirring to form a third composition and to this third composition there was added with stirring 40 parts of sodium nitrite, 1000 parts of finely divided trinitrotoluene of the type described in Example 1 and 1 part of zinc chromate. There was thus obtained an explosive composition having a density of 1.12 grams per cubic centimeter. This explosive composition was packed into cylindrical cardboard tubes which were 35 centimeters long and had a diameter of 5 centimeters. The explosive cartridges so obtained were detonated at a temperature of 26° C. using three No. 8 detonators.

EXAMPLE 13

An explosive composition containing 5% of hydrophobic PETN as a high explosive component of a sensitizing agent was made by preparing a first composition by mixing 7210 parts of ammonium nitrate powder, 598 parts of sodium nitrate powder and 1522 parts of water at 70° C. A second composition was prepared by mixing 30 parts of thiourea, 15 parts of guar gum, 35 parts of ethylene glycol, 1355 parts of crushed ammonium nitrate, 580 parts of urea, 250 parts of pregelled starch, 50 parts of sodium carboxymethylcellulose, 500 parts of a coarse atomized aluminium powder, 32.4 parts of sodium acetate and 8.7 parts of glacial acetic acid. This second composition was added to and mixed with 6650 parts of the first composition referred to above to form a homogeneous mixture which was slightly acid. This mixture was stirred further whilst there was added thereto 25 parts of sodium nitrite, 500 parts of treated PETN and 2 parts of potassium antimony tartrate. (The PETN referred to above was prepared by dissolving PETN in acetone and rapidly precipitating the PETN by adding water. Diisooctylphthalate—1% based on the weight of PETN—was added, the mixture stirred for 15 minutes, filtered and dried. This gave hydrophobic PETN particles of size range 2 to 10 microns). The composition so obtained which had a density of 1.13 grams/cubic centimeter was packed into cylindrical cardboard tubes which were 22 centimeters long and had a diameter of 2.5 centimeters. The composition was detonated in this unconfined state at a temperature of 21° C. by means of two No. 8 detonators.

EXAMPLE 14

This is a comparative example illustrating the necessity for the high explosive particles to be hydrophobic.

The general procedure of Example 13 was repeated except that untreated PETN powder was used. This composition of density 1.18 grams/cubic centimeter could *not* be detonated in a cardboard tube of diameter 2.5 centimeters by three No. 8 detonators.

I claim:

1. A slurry explosive composition comprising at least one inorganic oxidizing salt, a liquid phase, and fuel material wherein said slurry explosive composition comprises, as a sensitizing agent, (i) hydrophobic particles of a high explosive material which are capable of passing through a screen of 120 B.S. mesh and (ii) bubbles of gaseous material.

2. A composition according to claim 1 wherein said slurry explosive composition comprises a thickening agent.

3. A composition according to claim 2 wherein said thickening agent has been crosslinked.

4. A composition according to claim 1 wherein said high explosive material comprises at least one compound selected from the group consisting of trinitrotoluene, dinitrotoluene, pentaerythritol tetranitrate, pentolite, cyclonite, cyclotol and tetryl.

5. A composition according to claim 4 wherein said high explosive material is trinitrotoluene.

6. A composition according to claim 1 wherein said high explosive material has been treated with a compound to render it hydrophobic.

7. A composition according to claim 6 wherein the said compound used to render the high explosive material hydrophobic is di-iso-octylphthalate.

8. A composition according to claim 1 wherein said high explosive material comprises an amount in the range of 0.1% to 10% w/w inclusive of the said slurry explosive composition.

9. A composition according to claim 8 wherein said high explosive material comprises an amount in the range of 1% to 5% w/w inclusive of the said slurry explosive composition.

10. A composition according to claim 1 wherein said gaseous material comprises at least one gas selected from the group consisting of air, oxygen, nitrogen and oxides of nitrogen.

11. A process for the preparation of a slurry explosive compositions as defined in claim 1 in which hydrophobic particles of a high explosive material which are capable of passing a screen of 120 B.S. mesh are mixed with the other solid and liquid components of the said slurry explosive composition and wherein bubbles of gaseous material are generated within said slurry explosive composition.

12. A process according to claim 11 wherein the bubbles of gaseous material are generated within said slurry explosive composition by agitation.

13. A process according to claim 11 wherein the bubbles of gaseous material are generated within said slurry explosive composition by injection a compressed gas into the said composition.

14. A process according to claim 11 wherein the bubbles of gaseous material are generated within said slurry explosive composition by the addition of a material which will decompose to form gaseous products.

* * * * *